US010899594B2

(12) United States Patent
Riis

(10) Patent No.: US 10,899,594 B2
(45) Date of Patent: Jan. 26, 2021

(54) DISPENSING SYSTEM

(71) Applicant: MICRO MATIC A/S, Odense SV (DK)

(72) Inventor: Ken Riis, Odense SV (DK)

(73) Assignee: MICRO MATIC A/S, Odense SV (DK)

( * ) Notice: Subject to any disclaimer, the term of this patent is extended or adjusted under 35 U.S.C. 154(b) by 0 days.

(21) Appl. No.: 16/637,399

(22) PCT Filed: Aug. 22, 2018

(86) PCT No.: PCT/EP2018/072674
§ 371 (c)(1),
(2) Date: Feb. 7, 2020

(87) PCT Pub. No.: WO2019/038331
PCT Pub. Date: Feb. 28, 2019

(65) Prior Publication Data

US 2020/0189901 A1 Jun. 18, 2020

(30) Foreign Application Priority Data

Aug. 23, 2017 (EP) ..... 17187486

(51) Int. Cl.
*B67D 1/08* (2006.01)

(52) U.S. Cl.
CPC ..... *B67D 1/0831* (2013.01)

(58) Field of Classification Search
CPC .. B67D 1/0831; B67D 1/0839; B67D 1/0829; B67D 1/0835; B67D 1/0841; B67D 1/00; B67D 1/0042; B67D 2001/0093
(Continued)

(56) References Cited

U.S. PATENT DOCUMENTS 2,081,131 A * 5/1937 Barnes ..... B67D 1/0829 217/113
2,089,269 A * 8/1937 Kirchhan ..... B67D 1/0829 222/400.7

(Continued)

FOREIGN PATENT DOCUMENTS

WO 2015/036538 3/2015

OTHER PUBLICATIONS

International Preliminary Report on Patentability with Written Opinion dated Mar. 5, 2020 in International Application No. PCT/EP2018/072674, 9 pages.

(Continued)

*Primary Examiner* — Benjamin R Shaw
(74) *Attorney, Agent, or Firm* — Nixon & Vanderhye P.C.

(57) ABSTRACT

A dispensing system (100) for dispensing a beverage, comprising a beverage container (1) having an outlet (3), the outlet having a valve (2) arranged therein, the valve having a first inner face (12) and a first inner valve diameter (D1), and a one-way dispensing line (10), comprising a flexible tube (16), and a connecting unit (17) being configured to be inserted into the valve (2) for opening the valve, so that beverage present in the beverage container (1) may be dispensed via the dispensing line (10), the connecting unit (17) having an axial extension (Ae), and comprising a first part (18) configured to be connected with the flexible tube (16) and a second part (19), the first part (18) and the second part (19) are releasably connected to each other by a first connection force, wherein the second part (19) has at least one projectable member (28), projecting in a radial direction, the at least one projectable member (28) has an extension from the outer face of the second part (19), so that when the second part of the connecting unit (17) is inserted into the valve (2), the at least one protectable member (28) is configured to abut the first inner face of the valve by a (Continued)

Figure 1:
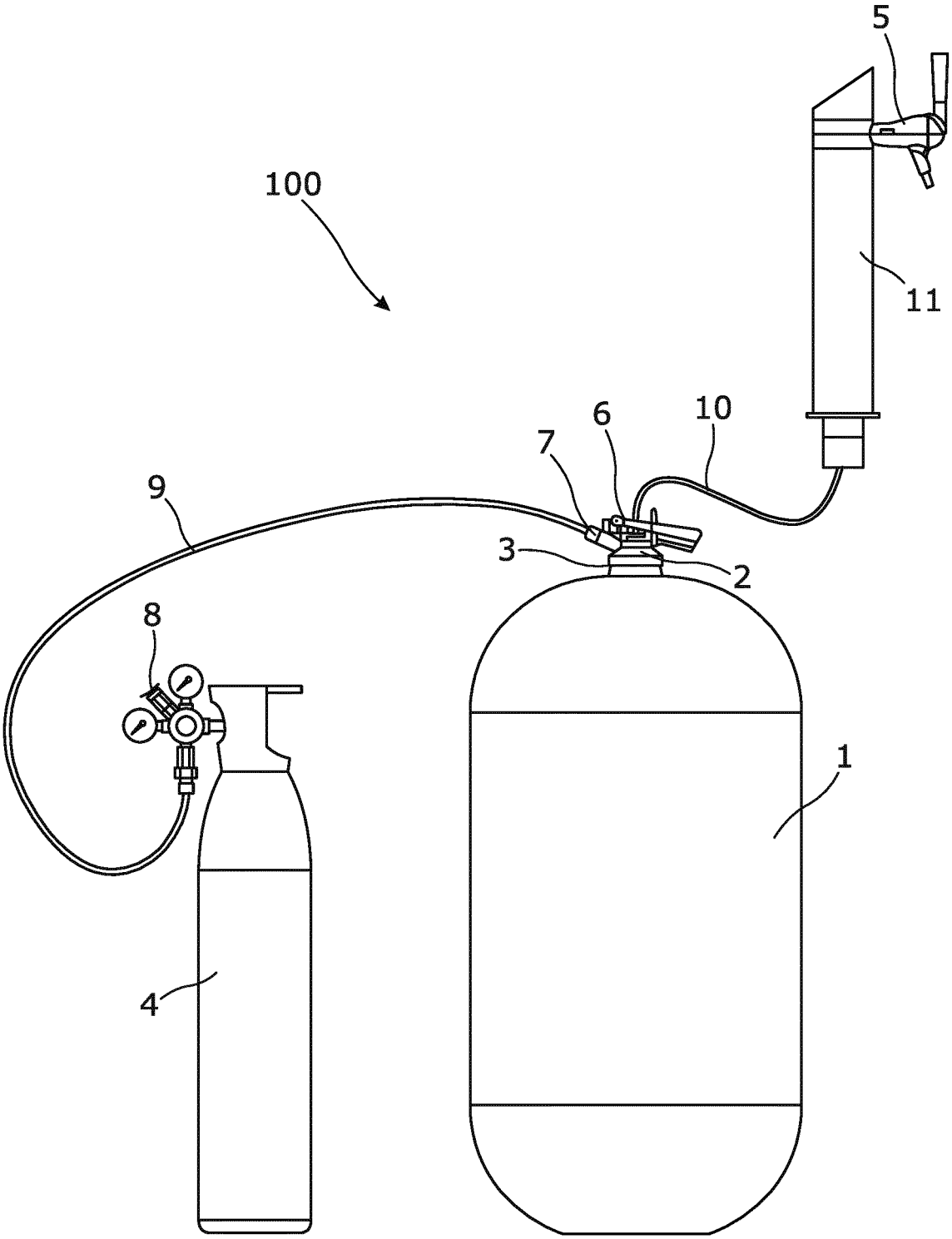

second connection therebetween, the second connection providing a second connection force, and the second connection force being larger than the first connection force.

16 Claims, 9 Drawing Sheets

(58) Field of Classification Search
USPC ..... 222/505
See application file for complete search history.

(56) References Cited

U.S. PATENT DOCUMENTS 3,228,413 A * 1/1966 Stevens, Jr. ..... B67D 1/0831 137/322
3,637,117 A * 1/1972 Johnston ..... B67D 1/0802 222/400.7
3,836,053 A * 9/1974 Johnston ..... B67D 1/0831 222/400.7
3,843,172 A * 10/1974 Stevens, Jr. ..... F16L 39/00 222/400.7
3,908,861 A * 9/1975 Johnston ..... B67D 1/0802 222/1
5,901,747 A * 5/1999 Rokkjaer ..... B67D 1/0835 137/212
2005/0127111 A1* 6/2005 Van der Klaauw ..... B67D 1/0832 222/400.7
2005/0247371 A1* 11/2005 Chadbourne ..... B67D 1/0835 141/351
2010/0181346 A1* 7/2010 Hanssen ..... B67D 1/0831 222/400.7
2012/0248139 A1* 10/2012 Haskayne ..... B67D 1/1411 222/1
2017/0113912 A1* 4/2017 Johnson ..... F16L 37/40
2018/0297832 A1* 10/2018 Fabbri ..... B67D 1/0835

OTHER PUBLICATIONS

International Search Report and Written Opinion of the ISA for PCT/EP2018/072674, dated Oct. 23, 2018, 15 pages.
Extended Search Report for EP17187486.0, dated Feb. 13, 2018, 8 pages.

* cited by examiner

DISPENSING SYSTEM

This application is the U.S. national phase of International Application No. PCT/EP2018/072674 filed 22 Aug. 2018, which designated the U.S. and claims priority to EP Patent Application No. 17187486.0 filed 23 Aug. 2017, the entire contents of each of which are hereby incorporated by reference.

The present invention relates to a dispensing system for dispensing a beverage, comprising a beverage container having an outlet, the outlet having a valve arranged therein, the valve having a first inner face and a first inner valve diameter, and a one-way dispensing line.

The consumers are more aware of the dispensing of beverages, such as beer, due to the fact that beer consumers have become increasingly aware of the quality of the beer they drink and they tend to base their beer label preferences on the final impression of the beer, i.e. the dispensed beer.

The impression of a newly dispensed beer is influenced by the taste and how it appears to the consumer. Also, the taste of the beer may change as the temperature of the beer varies. In view of this, it is of high importance that the dispensing devices serve the purpose of dispensing beer within the right temperature range and with the right amount of $CO_2$ in the beer.

The amount of $CO_2$ in a newly dispensed beer is influenced by the amount of $CO_2$ applied to the beer at the time of manufacture and also by the conditions under which the beer has been stored. The amount of $CO_2$ applied to the beer will migrate out of the beer if the beer is not kept under pressure in the beer keg. Therefore, it is very important that the pressure of the $CO_2$, besides being adequate for dispensing the beer, is also adequate for keeping the pressure balance in the beer keg, hence keeping the beer fizzy and foamy after dispensing.

Furthermore, beer dispensing devices have become accessible to more consumers and beer dispensing devices are increasingly being installed in private homes, companies, sports facilities etc., where no trained personnel operate the dispensing devices. Thus, the safety of the user of the dispensing device and the hygiene of the device have likewise become very important.

When dispensing beverages, such as beer, in a bar facility, it may sometimes be difficult for the personnel to clean the device properly, or it might just be de-emphasised in the daily routines.

Furthermore, during replacement of the beverage container, the dispensing line is often being reused without being cleaned. The consequence is that the dispensing line may contain old beverage and that e.g. bacteria are present. This may result in a bad taste of the beverage, or it may even, in some instances, constitute a health risk for the consumer.

In addition, dispensing systems applying the use of disposable beverage containers are being used more and more frequently. In this regard, a need has arisen for being able to connect the dispensing line with the disposable beverage container in an easy and expedient manner.

From US 2012/248139 A1 and WO 2015/036538 A1, prior dispensing systems are known.

It is an object of the present invention to wholly or partly overcome the above disadvantages and drawbacks of the prior art. More specifically, it is an object to provide a dispensing system which is easy to use in relation to connecting and disconnecting a dispensing line to a beverage container.

A further object of the present invention is to provide a dispensing system which ensures that the dispensing line may be used only once for one beverage container.

The above objects, together with numerous other objects, advantages and features, which will become evident from the below description, are accomplished by a solution in accordance with the present invention by a dispensing system for dispensing a beverage, comprising:

a beverage container having an outlet, the outlet having a valve arranged therein, the valve having a first inner face and a first inner valve diameter, and a one-way dispensing line comprising:

a flexible tube, and a connecting unit being configured to be inserted into the valve for opening the valve so that beverage present in the beverage container may be dispensed via a dispensing line, the connecting unit having an axial extension, and comprising a first part configured to be connected with the flexible tube, wherein the connecting unit comprises a second part having a first outer face, a first end and a first outer part diameter, the first part and the second part are releasably connected to each other by a first connection providing a first connection force, the first outer part diameter being substantially equal to or smaller than the first inner valve diameter, the second part has at least one projectable member, projecting in a radial direction from the first outer face of the second part at a position of the first outer part diameter, the at least one projectable member has an extension from the outer face of the second part, the first outer part diameter and the extension together being larger than the first inner valve diameter, so that when the second part of the connecting unit is inserted into the valve, the at least one protectable member is configured to abut the first inner face of the valve by a second connection therebetween, the second connection providing a second connection force, and the second connection force being larger than the first connection force.

The matter is that when the second part is brought into engagement with the valve of the beverage container, it is forced downwards. By this downward movement the projectable member bends slightly upwards, since there is not room for the projectable member between the first outer face of the second part and the first inner face of the valve. Thereby, the projectable member provides the second connection. When the beverage container is to be replaced, the connecting unit is pulled upwards. Since the projectable member bends slightly upwards, it will, when being pulled upwards, press even further outwards in relation to the first inner face, as it will try to unfold. The second part is thereby further secured to the valve due to the friction between the projectable member and the first inner face of the valve. Hence, the second connection force between the second part and the valve is considerably greater than the first connection force between the first part and the second part resulting in the first part being separated from the second part, when the connecting unit is being pulled upwards in relation to the valve. Hereby, it is ensured that the beverage container may be relieved pressure-wise, when the beverage container is to be replaced. In addition, since the connecting unit of the one-way dispensing line has been separated by the second part remaining in the valve of the beverage container, a new one-way dispensing line needs to be used with the new beverage container.

Also, the projectable member may project from the first outer face with a length, the length and the first outer part diameter of the second part being larger than the first inner valve diameter.

Furthermore, the projectable member may be made of a semi-rigid or rigid material.

Moreover, the material of the projectable member may be configured so that it may flex along the axial extension.

Also, the projectable member may be made of a polymeric material.

Further, a plurality of the projectable members may be arranged around the outer face of the second part.

In addition, the projectable member may be an annular disc circumferenting the first outer face of the second part.

Furthermore, the first outer face may have a circumferential groove wherein the annular disc is arranged.

The projectable member may be arranged at a distance from the first end.

Additionally, the first connection may be an O-ring connecting the first part and the second part, or the first part may be press-fitted into the second part, or in similar connections.

Also, the second part may have a fluid channel in which a first check valve is arranged.

Moreover, a second check valve may be arranged in the first part or in the flexible tube.

Further, the connecting unit and/or the valve may be made of a polymeric material.

In addition, a third connection between the flexible tube and the first part may be greater than the first connection between the first part and the second part, so that when the user pulls the flexible tube, the first connection between the first part and the second part will be released prior to the third connection between the flexible tube and the first part when the second part is mounted in the valve.

The dispensing system as described above may further comprise a dispense head configured to receive the connecting unit, so that after the dispense head has been coupled on top of the valve, it may open the valve by moving the connecting unit from a deactivated position to an activated position, in which activated position the second part of the connecting unit is moved into the valve for opening it.

Furthermore, the dispense head may comprise:

a housing having a through-going bore, the connecting unit being configured to be inserted into the through-going bore, and an activation handle pivotally mounted to the housing and movable between at least the deactivated position and the activated position.

Moreover, the connecting unit may be configured to be connected with the activation handle of the dispense head, when the connecting unit is provided in the through-going bore.

In addition, the first part of the connecting unit may comprise a protrusion, protruding upwards from the axial extension, the protrusion having a flange, configured to be connected with the activation handle of the dispense head.

Also, the activation handle may further comprise a gripping element pivotally mounted to the housing, the gripping element comprising at least one protruding leg being configured to receive the protrusion and entering into engagement with the connecting unit.

The connecting unit, when removably inserted into the through-bore, may be enclosed by the housing of the dispense head.

Finally, the activation handle may comprise an opening having a minimum diameter which is substantially equal to a maximum diameter of the connecting unit.

Figure 2:
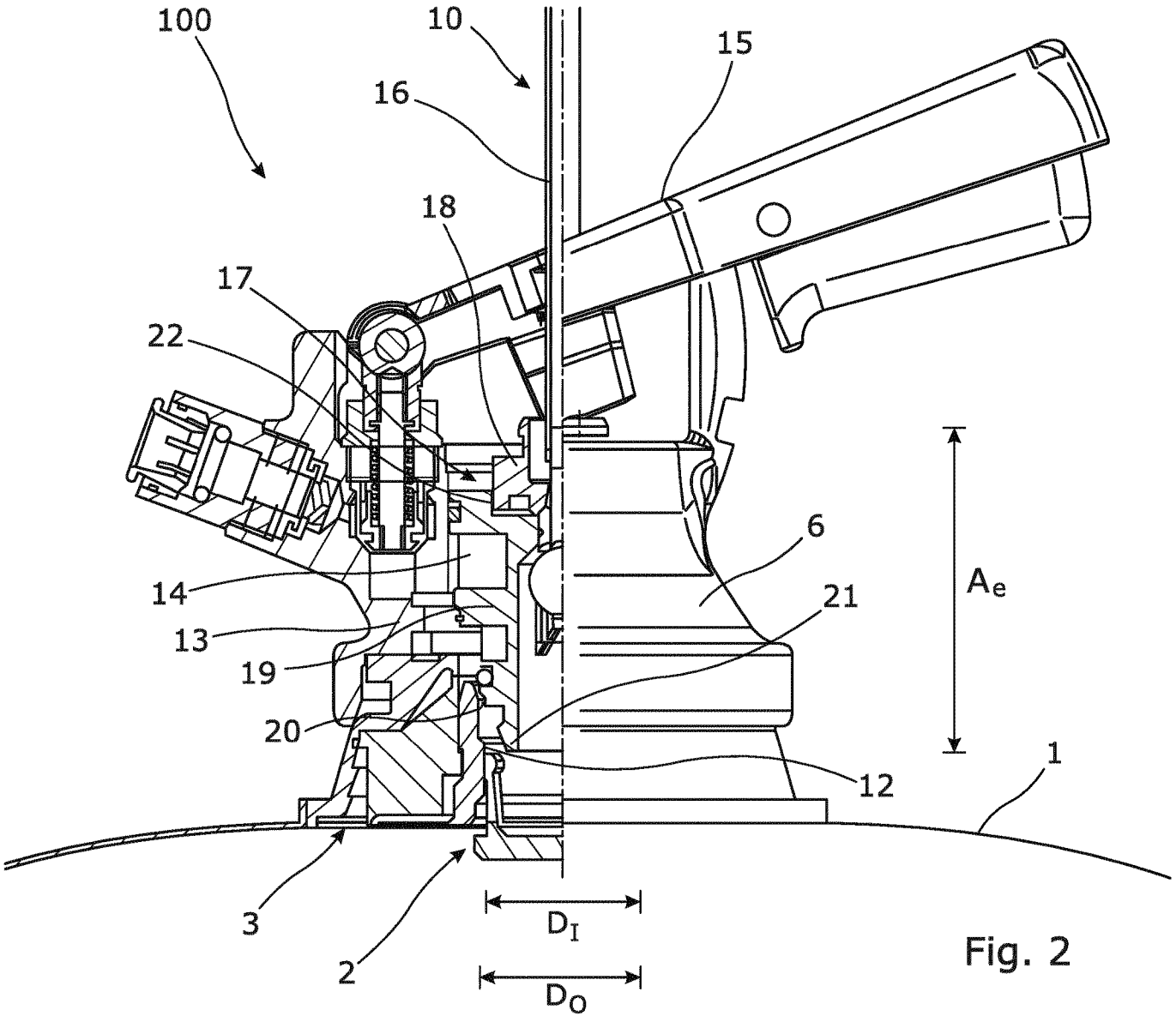
Figure 3:
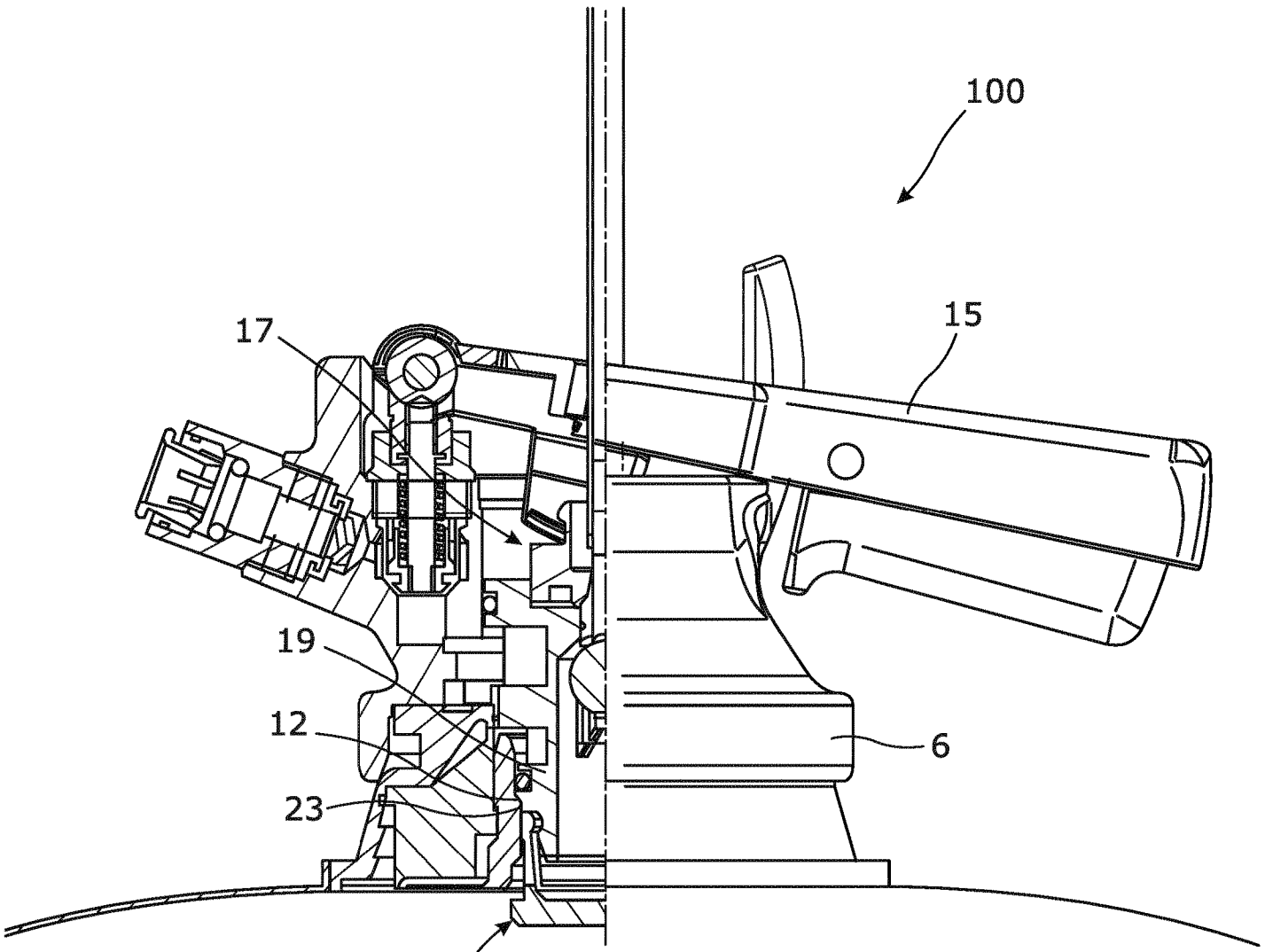
Figure 4:
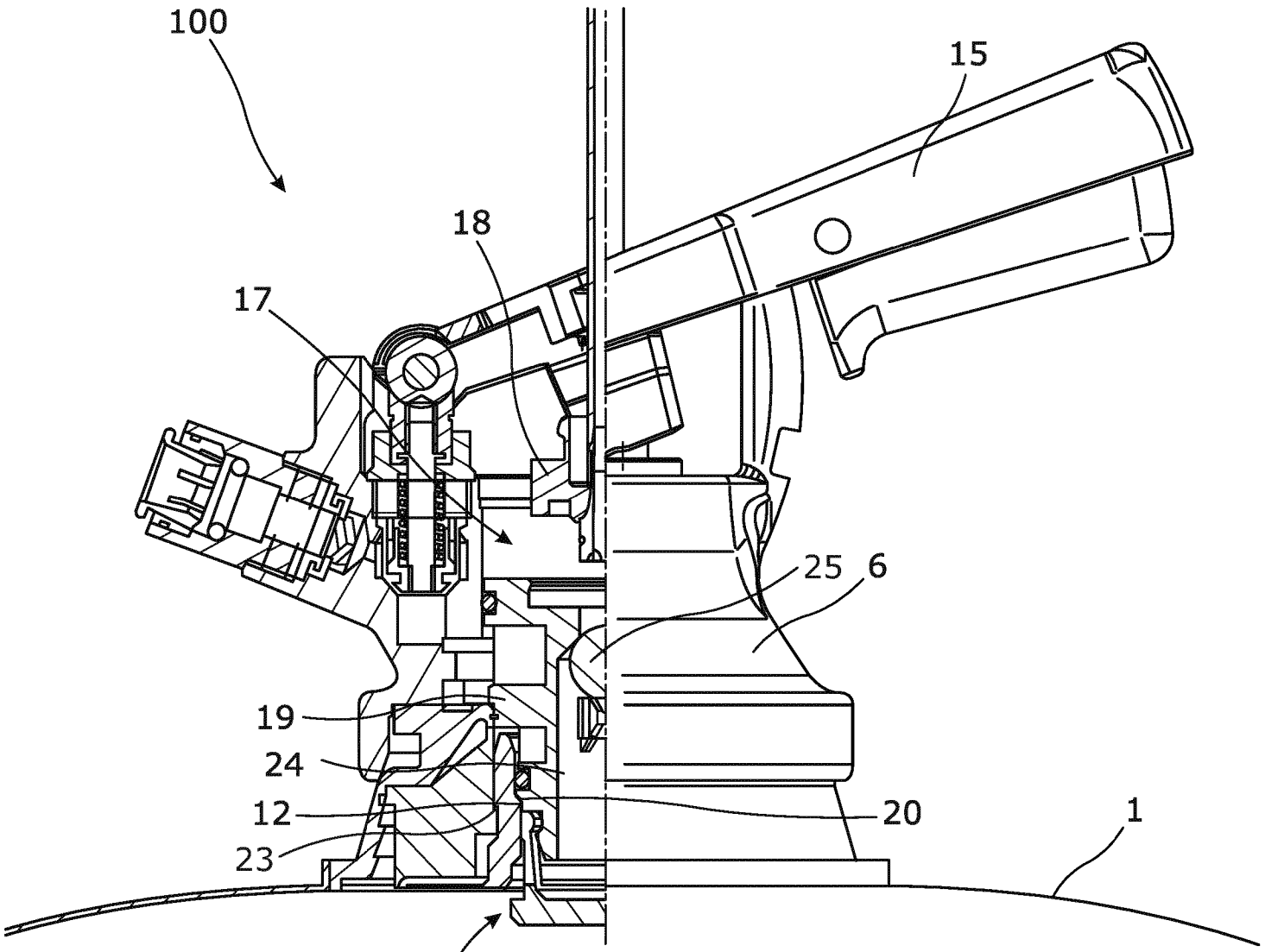
Figure 5:
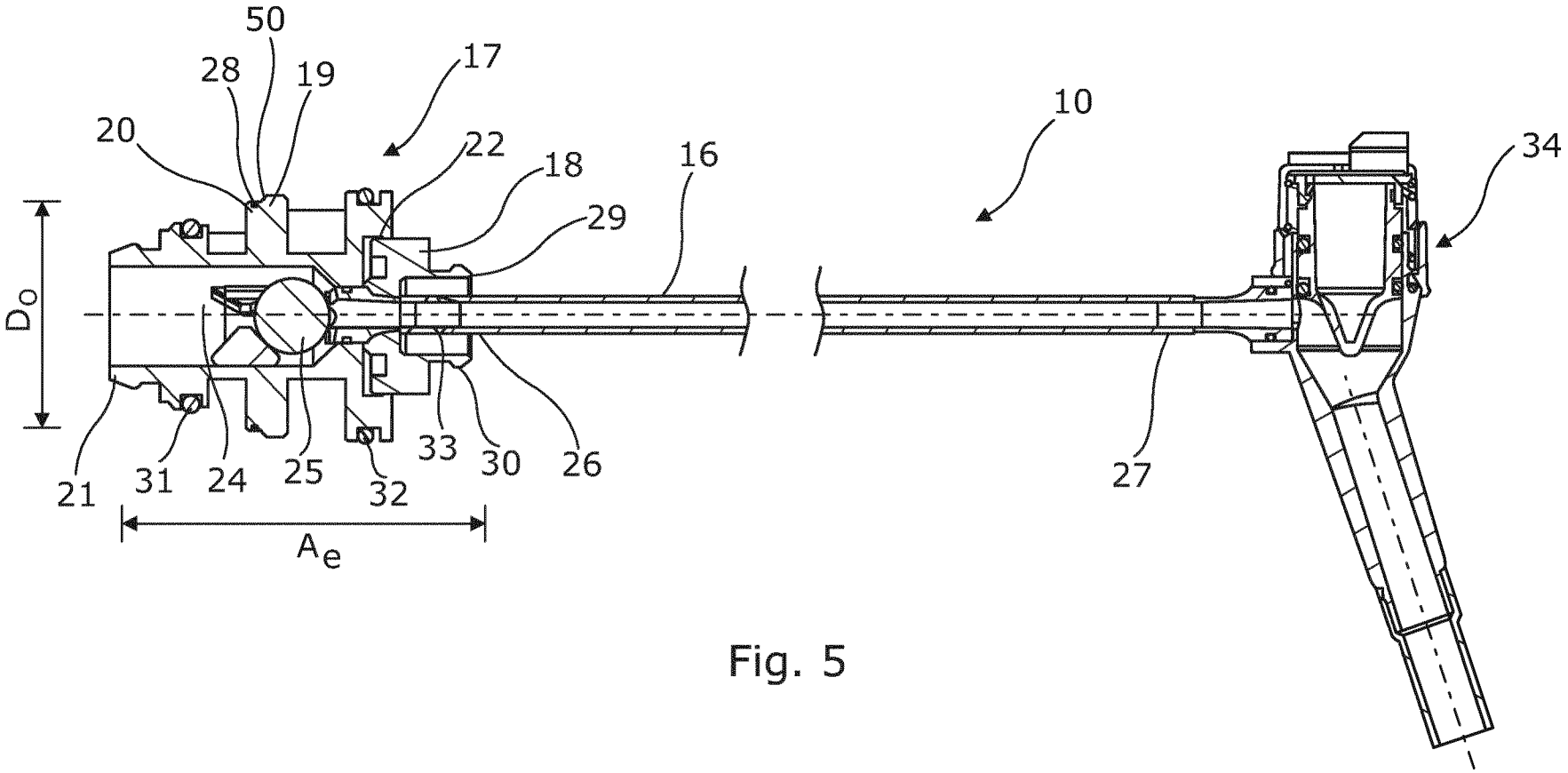
Figure 6:
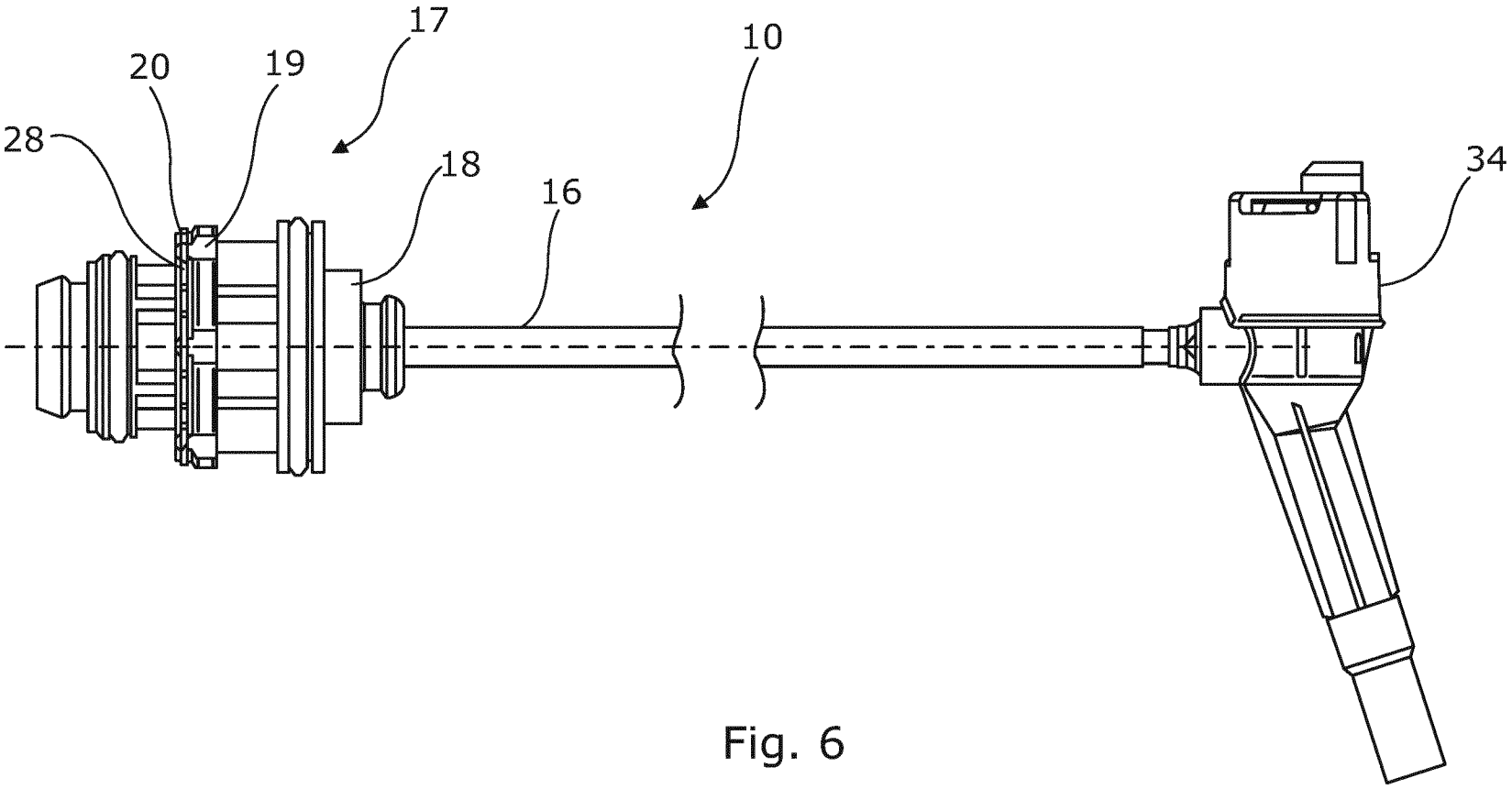
Figure 7:
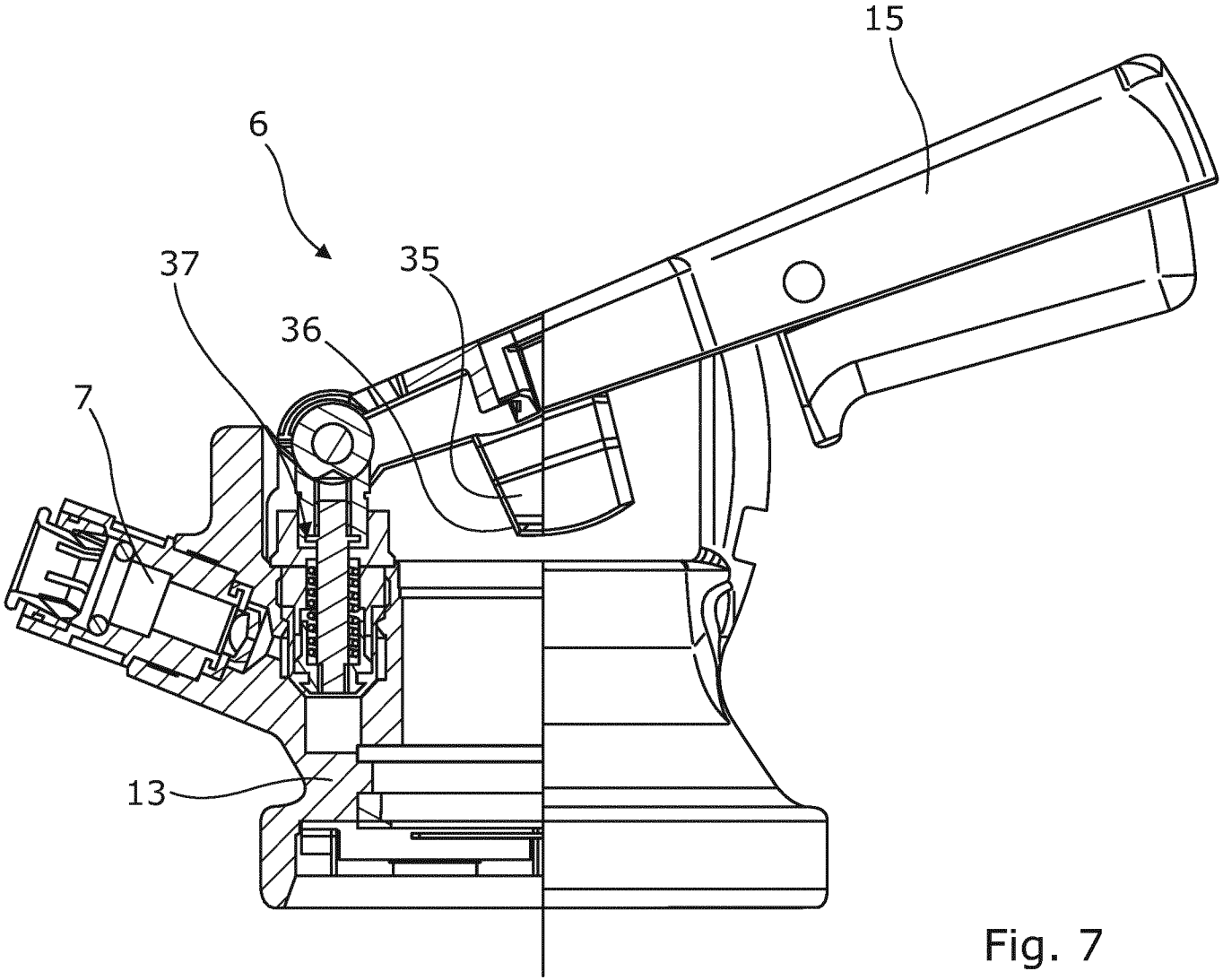
Figure 8:
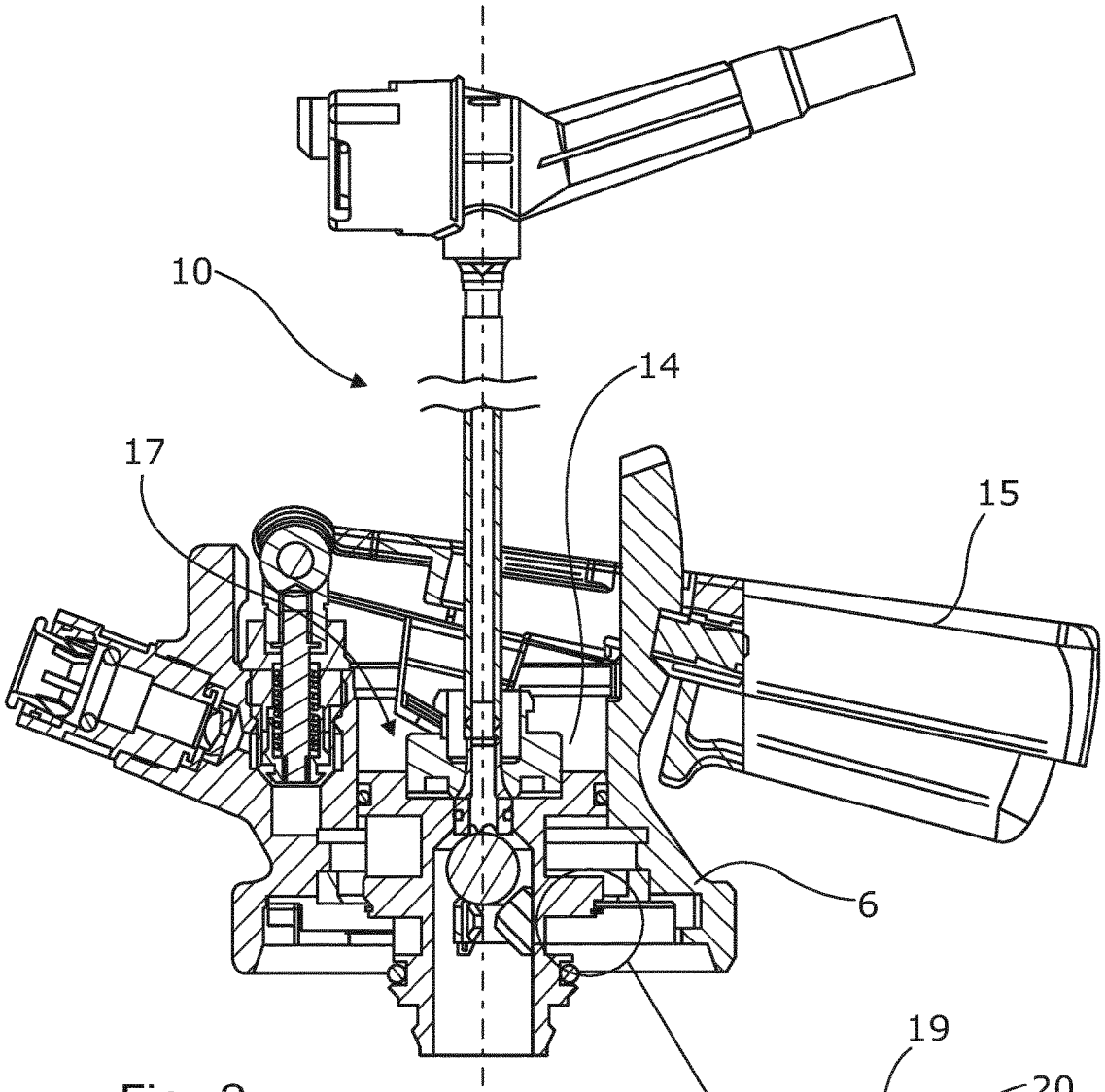
Figure 9:
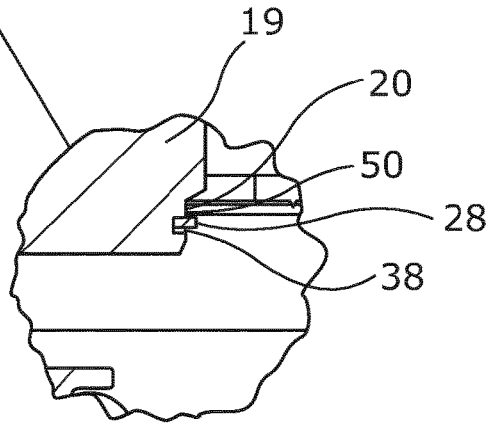
Figure 10:
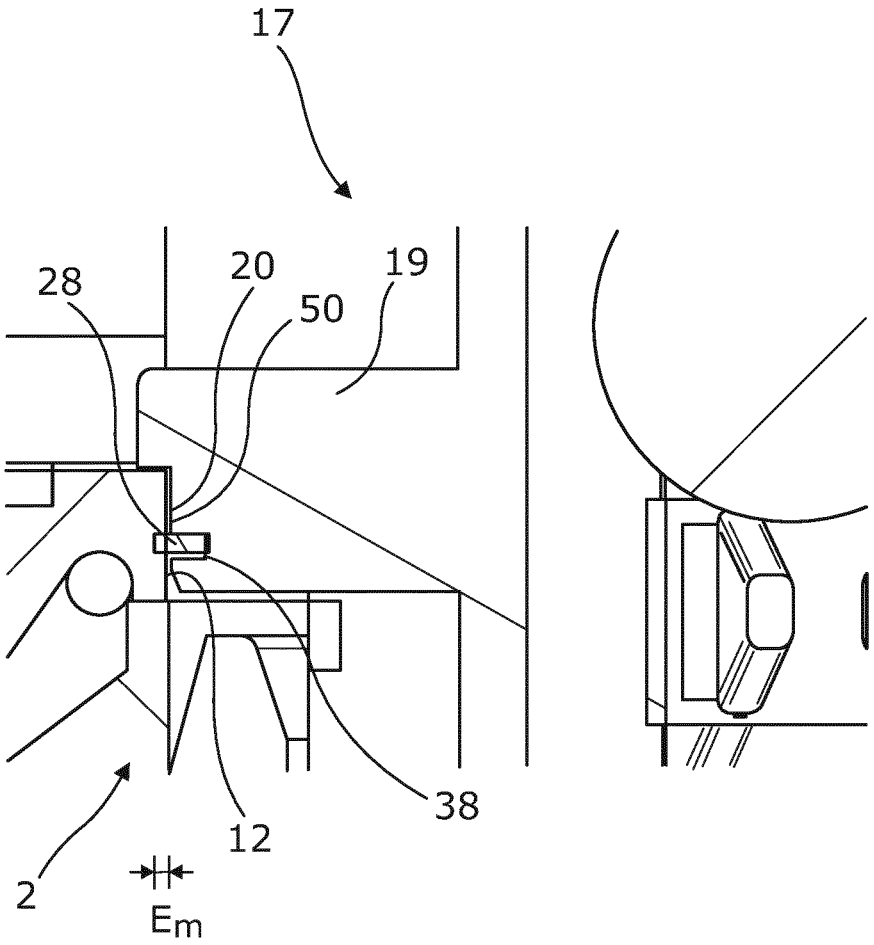

The invention and its many advantages will be described in more detail below with reference to the accompanying schematic drawings, which for the purpose of illustration show some non-limiting embodiments and in which:

FIG. 1 shows a dispensing system for dispensing beverages,

FIG. 2 shows a dispense head arranged on top of a valve of a beverage container in a deactivated position, FIG. 3 shows the dispense head of FIG. 2 in an activated position, FIG. 4 shows the dispense head in the deactivated position wherein the first part of the connecting unit has been separated from the second part of the connecting unit, FIG. 5 shows a one-way dispensing line in a cross-sectional view, FIG. 6 shows the one-way dispensing line, FIG. 7 shows a dispense head, FIG. 8 shows, in a cross-sectional view, the one-way dispensing line inserted into the dispense head, FIG. 9 is an enlarged view of the area A of FIG. 8, and FIG. 10 is an enlarged cross-sectional view of the second connection between the second part and the valve.

All the figures are highly schematic and not necessarily to scale, and they show only those parts which are necessary in order to elucidate the invention, other parts being omitted or merely suggested.

FIG. 1 shows a dispensing system 100 for dispensing beverages. The dispensing system 100 comprises a beverage container 1 comprising a valve 2 arranged in an outlet 3 of the beverage container 1. Furthermore, the dispensing system may comprise a gas supply 4, a dispensing tap 5, and a dispense head 6. The gas supply 4 is connected with a gas inlet 7 of the dispense head 6 via a gas regulator 8 and a gas supply line 9. From the dispense head 6 to the dispensing tap 5, a one-way dispensing line 10 extends. The dispensing line 10 may be configured to be guided from the dispense head 6 to the dispensing tap 5 via the tower 11 or from the dispensing tap 5 via the tower 11 to the dispense head 6, so that the one-way dispensing line 10 may be replaced each time the beverage container 1 is replaced. The one-way dispensing line 10 will be further described later.

The beverage container 1 may be fully or partly made of a polymeric material.

Also, the beverage container 1 may comprise a bag which is configured to contain a beverage, and the beverage in the bag is configured to be expelled by pressurising a container space between the bag and an inner container face of the beverage container.

In FIG. 2, the dispensing system 100 for dispensing a beverage is shown. In the right side of the figure, the dispensing system 100 is shown in a cross-sectional view and in the left side of the figure shown as seen from the outside. In this embodiment, the dispensing system 100 comprises a beverage container 1 having an outlet 3, the outlet 3 having a valve 2 arranged therein, the valve 2 having a first inner face 12 and a first inner valve diameter $D_I$.

Furthermore, a dispense head 6 is coupled, i.e. arranged opposite the valve, to the beverage container 1. The function of the dispense head 6 is well-known and will not be described in detail. The dispense head 6 is configured to receive a connecting unit of a one-way dispensing line 10, so that after the dispense head 6 has been coupled on top of the valve 2, it may open the valve 2 by moving the connecting unit from a deactivated position to an activated position, in which activated position the second part of the connecting unit is moved into the valve 2 for opening it. In FIG. 2, the deactivated position is shown.

The dispense head 6 comprises a housing 13 having a through-going bore 14, and an activation handle 15 pivotally mounted to the housing 13 and movable between at least the deactivated position (shown in FIG. 2) and the activated position (shown in FIG. 3).

The dispensing system 100 also comprises a one-way dispensing line 10 comprising a flexible tube 16, and a connecting unit 17 being configured to be inserted into the valve 2 for opening the valve 2 so that beverage present in the beverage container 1 may be dispensed via the one-way dispensing line 10. The connecting unit 17 is in this embodiment configured to be inserted into the through-going bore 14 of the dispense head 6. The connecting unit 17 has an axial extension $A_e$, and comprises a first part 18 configured to be connected with the flexible tube 16 and a second part 19 having a first outer face 20, a first end 21 and a first outer part diameter $D_O$. The first part 18 and the second part 19 are releasably connected to each other by a first connection 22 providing a first connection force, the first outer part diameter $D_O$ is substantially equal to or smaller than the first inner valve diameter $D_I$.

Moreover, the second part 19 has at least one projectable member (not seen in FIG. 2) projecting in a radial direction from the first outer face 20 of the second part 19 at a position of the first outer part diameter $D_O$, the at least one projectable member has an extension $E_m$ from the outer face of the second part, the first outer part diameter $D_O$ and the extension $E_m$ together being larger than the first inner valve diameter $D_I$.

In FIG. 3, the dispense head 6 of the dispensing system 100 is shown in the activated position. The activation handle 15 has been activated by pushing it downwards. By this downward movement of the activation handle, the activation handle 15 moves the connecting unit 17 downwards into engagement with the valve 2 for opening the valve 2. When the connecting unit 17 is moved downwards, the second part 19 of the at least one protectable member is configured to abut the first inner face 12 of the valve 2 by a second connection 23 therebetween, the second connection 23 providing a second connection force, and the second connection force being larger than the first connection force.

In FIG. 4, the activation handle 15 of the dispense head 6 is again brought into the deactivated position.

The matter is that when the second part 19 is brought into engagement with the valve 2 of the beverage container 1, it is forced downwards. By this downward movement, the projectable member bends slightly upwards since there is not room for the projectable member between the first outer face 20 of the second part 19 and the first inner face 12 of the valve 2. Thereby, the projectable member provides the second connection 23. When the beverage container 1 is to be replaced, the connecting unit 17 is pulled upwards, which in the present embodiment is done by moving the activation handle 15 from the activated position shown in FIG. 3 to the deactivated position shown in FIG. 4. Since the projectable member bends slightly upwards, it will, when being pulled upwards, press even further outwards in relation to the first inner face 12, as it will try to unfold. The second part 19 is thereby further secured to the valve 2 due to the friction between the projectable member and the first inner face 12 of the valve 2. Hence, the second connection force between the second part 19 and the valve 2 is considerably greater than the first connection force between the first part 18 and the second part 19 resulting in the first part 18 being separated from the second part 19, when the connecting unit 17 is being pulled upwards in relation to the valve 2 as shown in FIG. 4.

In addition, the second part 19 has a fluid channel 24 wherein a first check valve 25 is arranged. As is seen in FIG. 4, the first check valve 25 ensures that beverage present in the beverage container 1 does not leak out through the open valve 2.

Moreover, a second check valve (not shown) may be arranged in the first part or in the flexible tube for ensuring that potential beverage present in the flexible tube will not flow out of the flexible tube when the first part has been separated from the second, i.e. the remainder stays in the beverage container.

In FIG. 5, the one-way dispensing line 10 is shown in a cross-sectional view. The one-way dispensing line comprises a flexible tube 16 having a first tube end 26 and a second tube end 27. The first tube end 26 is connected with a connecting unit 17. The connecting unit 17 has an axial extension $A_e$, and comprises a first part 18 configured to be connected with the flexible tube 16 and a second part 19 having a first outer face 20, a first end 21, and a first outer part diameter $D_O$.

The first part 18 and the second part 19 are releasably connected to each other by a first connection 22 providing a first connection force.

Moreover, the second part 19 has at least one projectable member 28, projecting in a radial direction from the first outer face 20 of the second part 19 at the position 50 of the first outer part diameter.

In addition, the first part 18 of the connecting unit 17 comprises a protrusion 29 protruding upwards from the axial extension, the protrusion 29 having a flange 30 configured to be connected with the activation handle of the dispense head.

The second part 19 also comprises a first sealing 31 and a second sealing 32. In addition, the second part 19 has the check valve 25 arranged in the fluid channel 24.

The connecting unit 17 may have different designs compared to the design of the valve which it is configured to engage.

Furthermore, a third connection 33 between the flexible tube 16 and the first part 18 is greater than the first connection between the first part 18 and the second part 19, so that if the user pulls the flexible tube 16, the first connection between the first part 18 and the second part 19 will be released prior to the third connection 33 between the flexible tube 16 and the first part 18 when the second part 19 is mounted in the valve.

In the second end 27 of the flexible tube 16, a dispense valve 34 is fluidly connected with the flexible tube 16. The dispense valve 34 is configured to be connected with a tapping device having activation means, so that when the connecting unit has activated the valve in the open position, beverage may be dispensed through the dispense valve 34.

In FIG. 6, the one-way dispensing line 10 is shown. The one-way dispensing line 10 comprises the flexible tube 16, the connecting unit 17 and the dispense valve 34. The connecting unit 17 comprises a first part 18 configured to be connected with the flexible tube 16 and a second part 19 having a first outer face 20. Moreover, the second part 19 has at least one projectable member 28, projecting in a radial direction from the first outer face 20 of the second part 19.

In the present embodiment, the projectable member 28 is an annular disc circumferenting the first outer face 20 of the second part 19. The first outer face 20 has a circumferential groove wherein the annular disc is arranged. Hereby, it is ensured that the connecting unit 17 is centralised in relation to the valve when being moved downwards into engagement with the valve.

The projectable member 28 projects from the first outer face 20 with a length, and the length and the first outer part diameter $D_O$ of the second part 19 are larger than the first inner valve diameter $D_I$.

Advantageously, the projectable member 28 is made of a semi-rigid or rigid material. The projectable member is made of a polymeric material.

In addition, the material of the projectable member is configured, so that it may flex along the axial extension.

In another not shown embodiment, a plurality of the projectable members is arranged around the first outer face of the second part.

In FIG. 7, the dispense head 6 is shown partly in a cross-sectional view. The activation handle 15 comprises a gripping element 35 pivotally mounted to the housing 13. The gripping element 35 comprises at least one protruding leg 36 being adapted to receiving the protrusion and entering into engagement with the connecting unit. The dispensing head 6 further comprises a gas inlet 7 and a gas shut-off element 37.

In FIG. 8, the connecting unit 17 of the one-way dispensing line 10 is inserted in the through-going bore 14 of the dispense head 6. The activation handle 15 is in its activated position. The encircled area A in FIG. 8 is shown in an enlarged view in FIG. 9. From this enlarged view, the projectable member 28 is visible where it projects from the first outer face 20 of the second part 19 at the position 50 of the first outer part diameter. In addition, the projectable member is arranged in a groove 38 in the first outer face 20.

FIG. 10 shows an enlarged cross-sectional view of a part of the connecting unit 17 and the valve 2. From the enlarged view the projectable member 28 is arranged in the groove 38 in the first outer face 20 of the second part 19 at the position 50 of the first outer part diameter. The at least one projectable member 28 has an extension $E_m$ from the outer face of the second part, the first outer part diameter $D_O$ (not shown) and the extension $E_m$ together being larger than the first inner valve diameter $D_I$ (not shown). The projectable member 28 and the first outer face 20 are abutting the first inner face 12 of the valve 2.

Although the invention has been described in the above in connection with preferred embodiments of the invention, it will be evident for a person skilled in the art that several modifications are conceivable without departing from the invention as defined by the following claims.

The invention claimed is:

1. A dispensing system for dispensing a beverage, comprising:

a beverage container having an outlet, the outlet having a valve arranged therein, the valve having a first inner face and a first inner valve diameter, and a one-way dispensing line comprising:

a flexible tube, and a connecting unit being configured to be inserted into the valve for opening the valve so that beverage present in the beverage container may be dispensed via the dispensing line, the connecting unit having an axial extension, and comprising a first part configured to be connected with the flexible tube, wherein the connecting unit comprises a second part having a first outer face, a first end and a first outer part diameter, the first part and the second part are releasably connected to each other by a first connection providing a first connection force, the first outer part diameter being substantially equal to or smaller than the first inner valve diameter, the second part has at least one projectable member projecting in a radial direction from the first outer face of the second part at a position of the first outer part diameter, the at least one projectable member has an extension from the outer face of the second part, the first outer part diameter and the extension together being larger than the first inner valve diameter so that when the second part of the connecting unit is inserted into the valve, the at least one protectable member is configured to abut the first inner face of the valve by a second connection therebetween, the second connection providing a second connection force, and the second connection force being larger than the first connection force.

2. A dispensing system according to claim 1, wherein the projectable member projects from the first outer face with a length, the length and the first outer part diameter of the second part being larger than the first inner valve diameter.

3. A dispensing system according to claim 1, wherein the projectable member is made of a semi-rigid or rigid material.

4. A dispensing system according to claim 1, wherein the material of the projectable member is configured, so that it may flex along the axial extension.

5. A dispensing system according to claim 1, wherein the projectable member is an annular disc circumferenting the first outer face of the second part.

6. A dispensing system according to claim 5, wherein the first outer face has a circumferential groove wherein the annular disc is arranged.

7. A dispensing system according to claim 1, wherein the first connection is an O-ring connecting the first part and the second part, or the first part is press-fitted into the second part, or in similar connections.

8. A dispensing system according to claim 1, wherein the second part has a fluid channel in which a first check valve is arranged.

9. A dispensing system according to claim 1, wherein a second check valve is arranged in the first part or in the flexible tube.

10. A dispensing system according to claim 1, wherein the connecting unit and/or the valve is/are made of a polymeric material.

11. A dispensing system according to claim 1, further comprising a dispense head configured to receive the connecting unit so that after the dispense head has been coupled on top of the valve, it may open the valve by moving the connecting unit from a deactivated position to an activated position, in which activated position the second part of the connecting unit is moved into the valve for opening it.

12. A dispensing system according to claim 11, wherein the dispense head comprises:

a housing having a through-going bore, the connecting unit being configured to be inserted into the through-going bore, and an activation handle pivotally mounted to the housing and movable between at least the deactivated position and the activated position.

13. A dispensing system according to claim 12, wherein the connecting unit is configured to be connected with the activation handle of the dispense head when the connecting unit is provided in the through-going bore.

14. A dispensing system according to claim 12, wherein the first part of the connecting unit comprises a protrusion protruding upwards from the axial extension, the protrusion having a flange configured to be connected with the activation handle of the dispense head.

15. A dispensing system according to claim 14, wherein the activation handle further comprises a gripping element pivotally mounted to the housing, the gripping element comprising at least one protruding leg being configured to receive the protrusion and entering into engagement with the connecting unit.

16. A dispensing system according to claim 12, wherein the activation handle comprises an opening having a minimum diameter which is substantially equal to a maximum diameter of the connecting unit.

* * * * *